US006302710B1

(12) United States Patent
Wang et al.

(10) Patent No.: US 6,302,710 B1
(45) Date of Patent: Oct. 16, 2001

(54) ELECTRICAL CONNECTOR ASSEMBLY FOR VERTICALLY CONNECTING TWO ELECTRICAL DEVICES TOGETHER

(75) Inventors: Chi-Sheng Wang; Yueh-Shan Shih, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/738,914

(22) Filed: Dec. 13, 2000

(30) Foreign Application Priority Data

Aug. 10, 2000 (TW) ..... 089213924

(51) Int. Cl.[7] ..... H01R 12/20
(52) U.S. Cl. ..... 439/79; 439/541.5
(58) Field of Search ..... 439/79, 74, 64, 439/541.5, 80, 660, 377

(56) References Cited

U.S. PATENT DOCUMENTS 5,636,999 * 6/1997 Hirai et al. ..... 439/79
5,688,130 * 11/1997 Huang ..... 439/79
5,967,831 * 10/1999 Yamada et al. ..... 439/79
6,089,878 * 7/2000 Meng ..... 439/79

* cited by examiner

*Primary Examiner*—Hien Vu
(74) *Attorney, Agent, or Firm*—Wei Te Chung

(57) ABSTRACT

An electrical connector assembly comprises a first connector (1) and a second connector (2). The first connector comprises an upper housing(10) having a main body (101), and a lower housing (12). The lower housing has a body board (120) with a plurality of recesses (124) on opposite sides thereof, and a plurality of first contacts (14). Each recess defines a depression (126) at an end thereof. Each first contact includes a flat leg (144) received in the recess with a projection (146) received in the depression, and a pair of protrusions (147) interferingly engaging with sides of the recess. The second connector comprises a housing (20) having a slot (204) and a plurality of second contacts (22). The body board is adapted to extend into the slot and support reliable engagement of the legs of the first contacts with mating portions (220) of the second contacts.

7 Claims, 6 Drawing Sheets

ELECTRICAL CONNECTOR ASSEMBLY FOR VERTICALLY CONNECTING TWO ELECTRICAL DEVICES TOGETHER

BACKGROUND OF THE INVENTION

1. Field of the Invention

The present invention relates to an electrical connector assembly, and more particularly to an electrical connector assembly for connecting with a media storage device and a portable electronic device.

2. Brief Description of the Related Art

A hard disk drive is connected with a mother board of a portable electronic device, for example a notebook computer, by an electrical connector assembly. Conventionally, as shown in FIG. 7, a connector assembly 7 comprises a first connector 70 and a second connector 78. The first connector 70 includes a dielectric housing 71 defining a plurality of passageways 73, and a plurality of terminals. Each terminal has a mating section 713 received in a corresponding passageway 73, and a mating end 721 protruding from the passageway 73 for mating with a corresponding terminal (not shown) of the second connector 78. Since the mating ends 721 are long and freely movable. Thus when the first connector 70 is mounted to the second connector 78, the mating ends 721 are prone to misengage or even fail to engage with the corresponding terminals of the second connector 78.

Hence, an improved electrical assembly is required to overcome the disadvantages of the prior art.

BRIEF SUMMARY OF THE INVENTION

A main object of the present invention is to provide an electrical connector assembly for connecting a media storing device with a printed circuit board, wherein reliable electrical connection is established between a first connector and a second connector of the electrical connector assembly.

To achieve the above-mentioned object, an electrical connector assembly in a first embodiment of the prevent invention includes a first connector and a second connector. The first connector comprises an insulative upper housing, an insulative lower housing, and a plurality of L-shaped first contacts secured in the upper and lower housings. The upper housing has a main body defining a mating surface for mating with the media storing device, and an intermediate surface opposite the mating surface. The lower housing includes a transition board, and an insulative body board extending perpendicularly from the transition board and defining a plurality of recesses on opposite sides thereof. Each recess communicates with a depression at an end thereof. In assembly, the transition board abuts against the intermediate surface, and the body board is perpendicular to the main body. Each first contact includes a flat leg received in the recess, and a pair of protrusions interferingly engaging with sides of the recess. Each leg has a projection at a free end thereof for being received in the corresponding depression.

The body board supports and maintains the legs in position, thereby ensuring reliable electrical connection between the first and second contacts.

Other objects, advantages and novel features of the invention will become more apparent from the following detailed description of the present embodiment when taken in conjunction with the accompanying drawings.

DETAILED DESCRIPTION OF THE INVENTION

Figure 1:
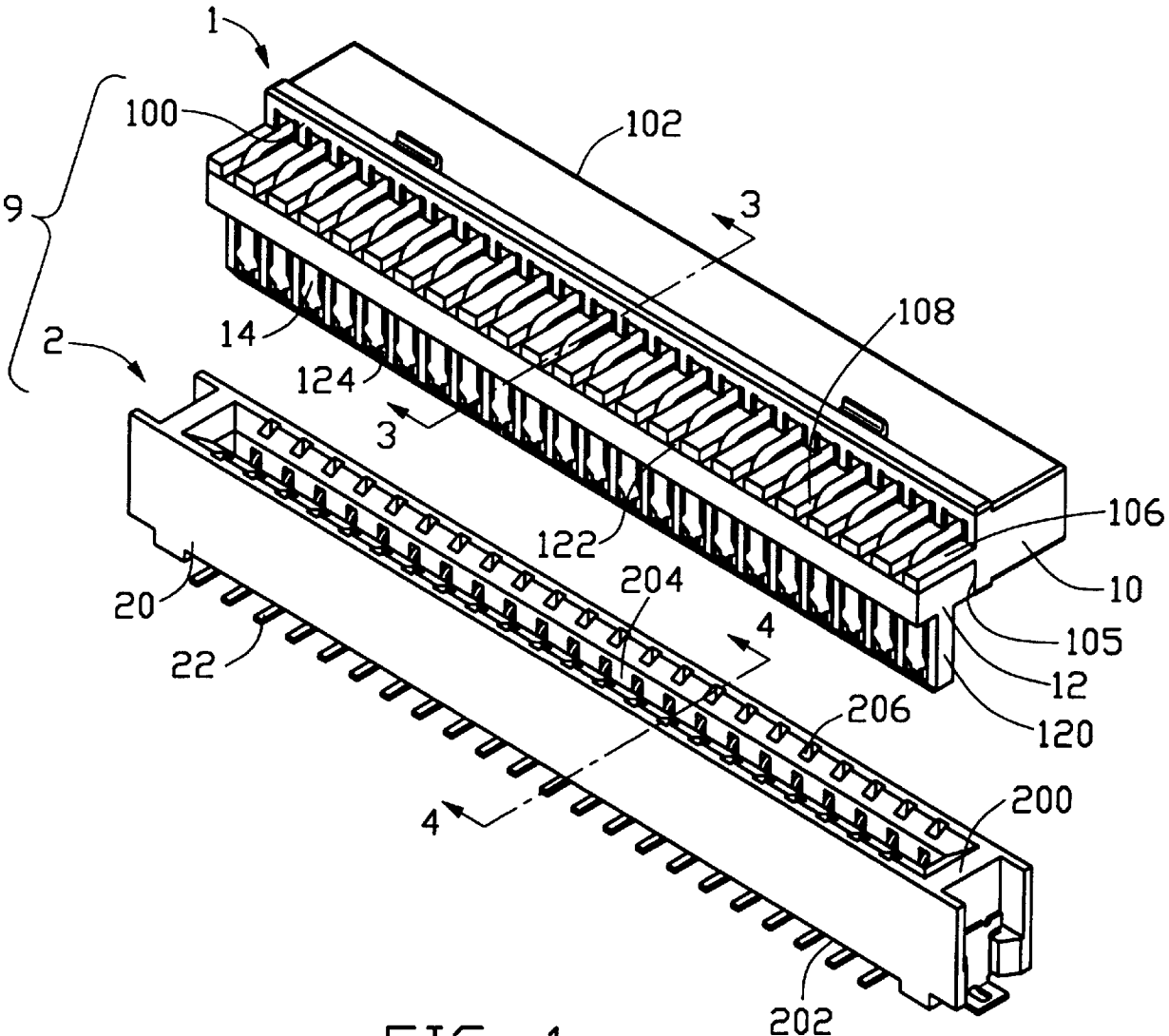
FIG. 1 is a partly exploded view of an electrical connector assembly in accordance with a first embodiment of the present invention.

Referring to FIG. 1, an electrical connector assembly 9 in accordance with a first embodiment of the present invention comprises a first connector 1 and a second connector 2.

Figure 2:
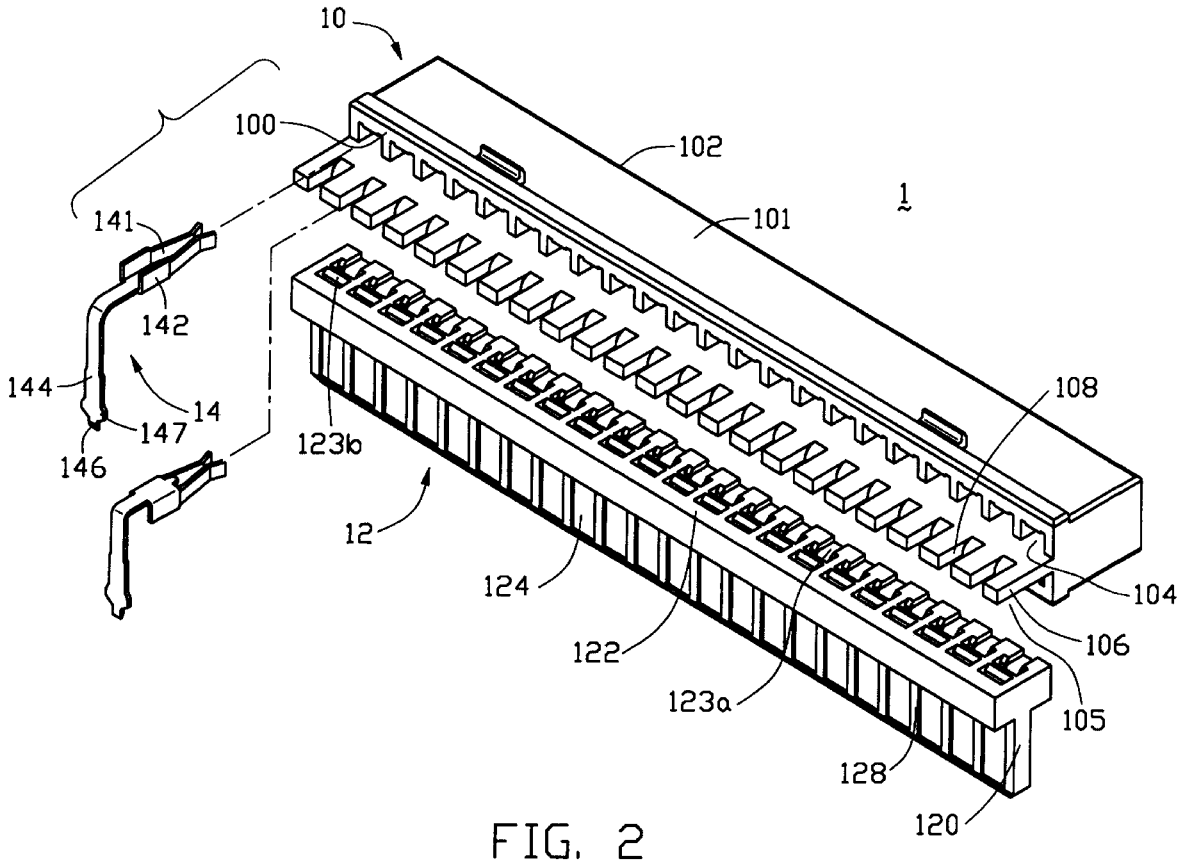
FIG. 2 is an exploded view of a first connector of the electrical connector assembly of FIG. 1.

Referring also to FIG. 2, the first connector 1 comprises an insulative upper housing 10, an insulative lower housing 12, and a plurality of conductive first contacts 14. The upper housing 10 has a main body 101 which defines a mating surface 102 for engaging with a media storage device 3, an intermediate surface 100 opposite the mating surface 102, and upper and lower rows of first passageways 104 extending from the mating surface 102 to the intermediate surface 100. A securing board 106 extends perpendicularly from the intermediate surface 100 of the main body 101 between the upper and lower rows of the passageways 104, and defines a plurality of cutouts 108 in a free end thereof. Each cutout 108 is in alignment with a corresponding first passageway 104. A box-shaped space 105 is defined between a bottom side of the securing board 106 and the intermediate surface 100.

The lower housing 12 has a T-shaped profile. The lower housing 12 comprises a transition board 122 and an insulative body board 120 extending downwardly from the transition board 122. The transition board 122 defines a plurality of grooves 123*a* and 123*b* respectively arranged in two rows. A plurality of recesses 124 is symmetrically defined on opposite sides of the body board 120, in communication with the grooves 123*a* and 123*b*. The body board 120 forms a plurality of ribs 128 between adjacent recesses 124 and a plurality of depressions 126 (see FIG. 3) communicating with the recesses 124 at a free end of the body board 120.

The first contacts 14 are L-shaped, and are arranged in upper and lower rows. Each first contact 14 includes a socket section 142, a pair of mating fingers 141 extending rearwardly from the socket section 142, and a flat leg 144 bending downwardly from the socket section 142. Each leg 144 of each first contact 14 forms a projection 146 at a free end thereof, and a pair of protrusions 147 extending from respective opposite lateral sides of the leg 144 adjacent the projection 146.

Figure 3:
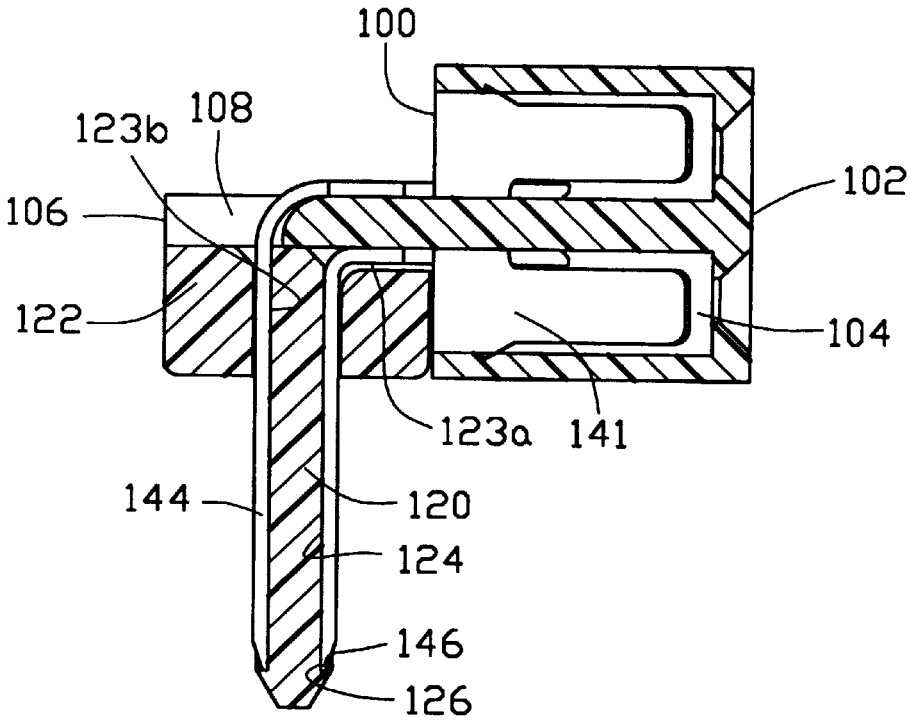
FIG. 3 is a cross-sectional view of the first connector of FIG. 1, taken along the line 3—3.

Referring also to FIG. 3, in assembly, the transition board 122 of the lower housing 12 is accommodated in the space 105 of the housing 10 such that the body board 120 is perpendicular to the main body 101. The recesses 124 are oriented perpendicularly to the first passageways 104, which together receive the first contacts 14.

The first contacts 14 are received in the first passageways 104 and the recesses 124 such that the socket sections 142 and the mating fingers 141 are received in the first passageways 104 and the legs 144 are secured in the recesses 124. The projections 146 of the legs 144 wedge into the corresponding depressions 126, and the protrusions 147 of the legs 144 interferingly engage with the corresponding ribs 128. The legs 144 of the lower row of first contacts 14 extend directly from the intermediate surface 100 through the grooves 123*a* into the recesses 124. The legs 144 of the upper row of first contacts 14 extend through the cutouts 108 and the grooves 123*b* into the recesses 124.

Figure 4:
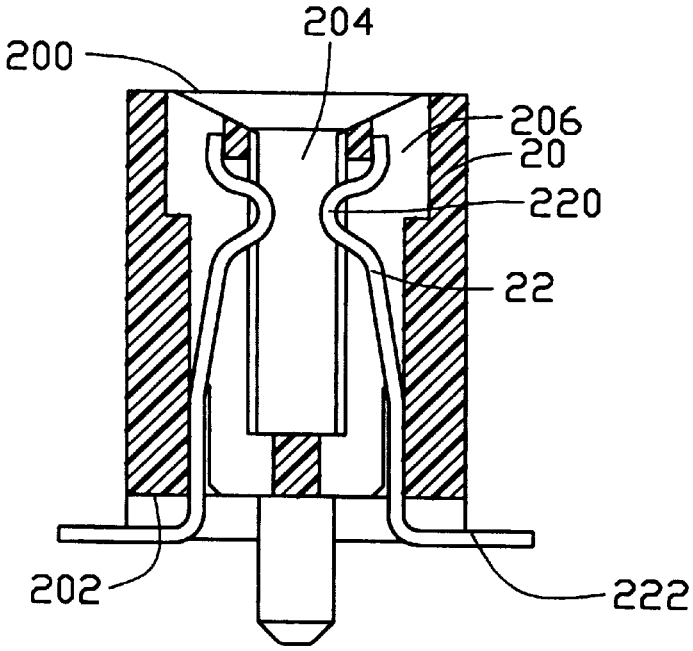
FIG. 4 is a cross-sectional view of a second connector of FIG. 1, taken along the line 4—4.

Referring also to FIG. 4, the second connector 2 comprises a dielectric housing 20 and a plurality of second contacts 22 secured in the housing 20. The housing 20 defines two rows of second passageways 206 extending from an upper surface 200 to a lower surface 202 of the housing 20, and a slot 204 communicating with the two rows of second passageways 206. Each second contact 22 has a mating portion 220 extending into the slot 204, and a solder portion 222 extending beyond the lower surface 202.

Figure 5:
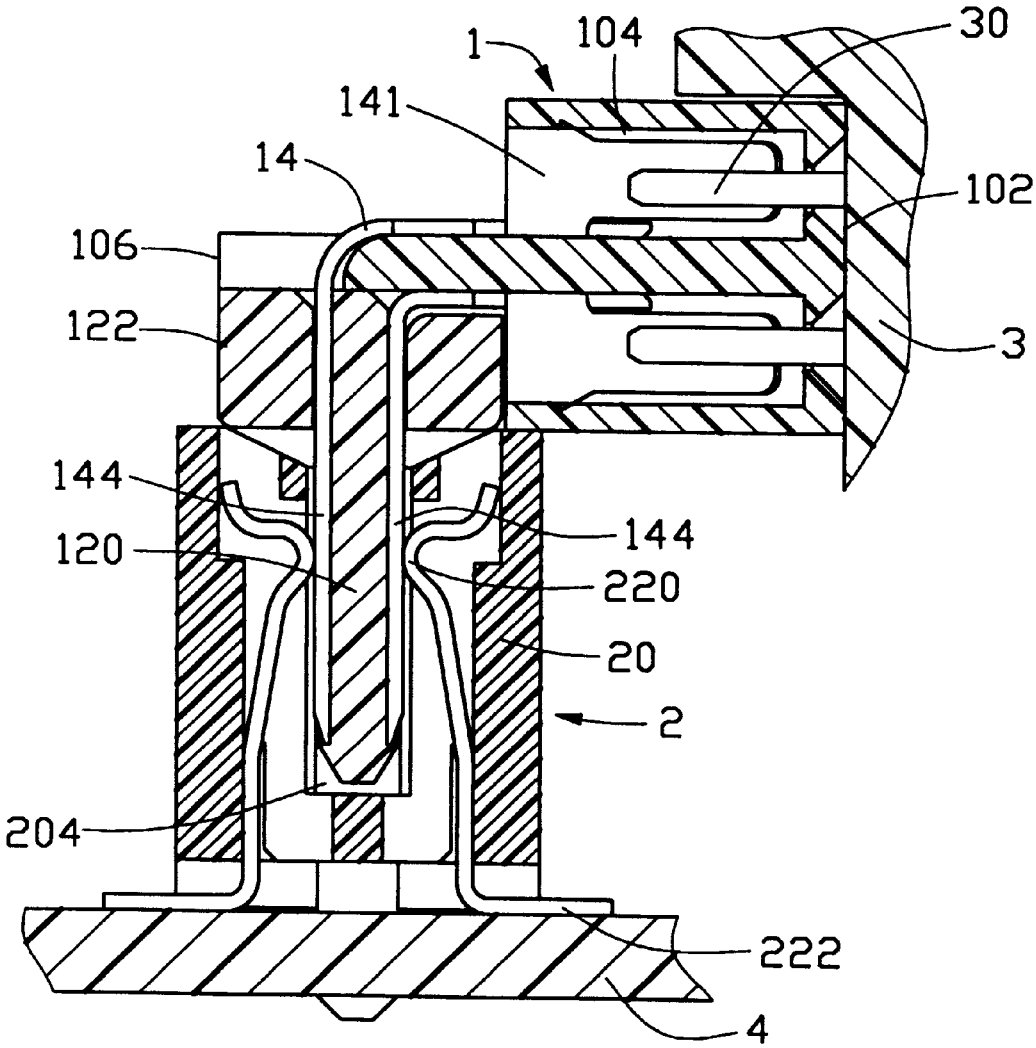
FIG. 5 is a cross-sectional view of the first connector of FIG. 3 engaged with both a media storage device and the second connector of FIG. 4 mounted on a printed circuit board.

As is shown in FIG. 5, the electrical connector assembly connects the media storing device 3 with the printed circuit board 4. The mating fingers 141 of the first contacts 14 engage with pins 30 of the media storing device 3, and the solder portions 222 of the second contacts 22 are soldered to the printed circuit board 4. The mating surface 102 of the upper housing 10 is perpendicular to the printed circuit board 4, enabling the media storing device 3 to be secured in a position parallel to the printed circuit board 4. The body board 120 is inserted into the slot 204. The legs 144 of the first contacts 14 resiliently engage with the mating portions 220 of the corresponding second contacts 22, thereby establishing an electrical connection between the first connector 1 and the second connector 2. The body board 120 supports and maintains the legs 144 in position, thereby ensuring reliable connection between the first contacts 14 and the second contacts 22.

Figure 6:
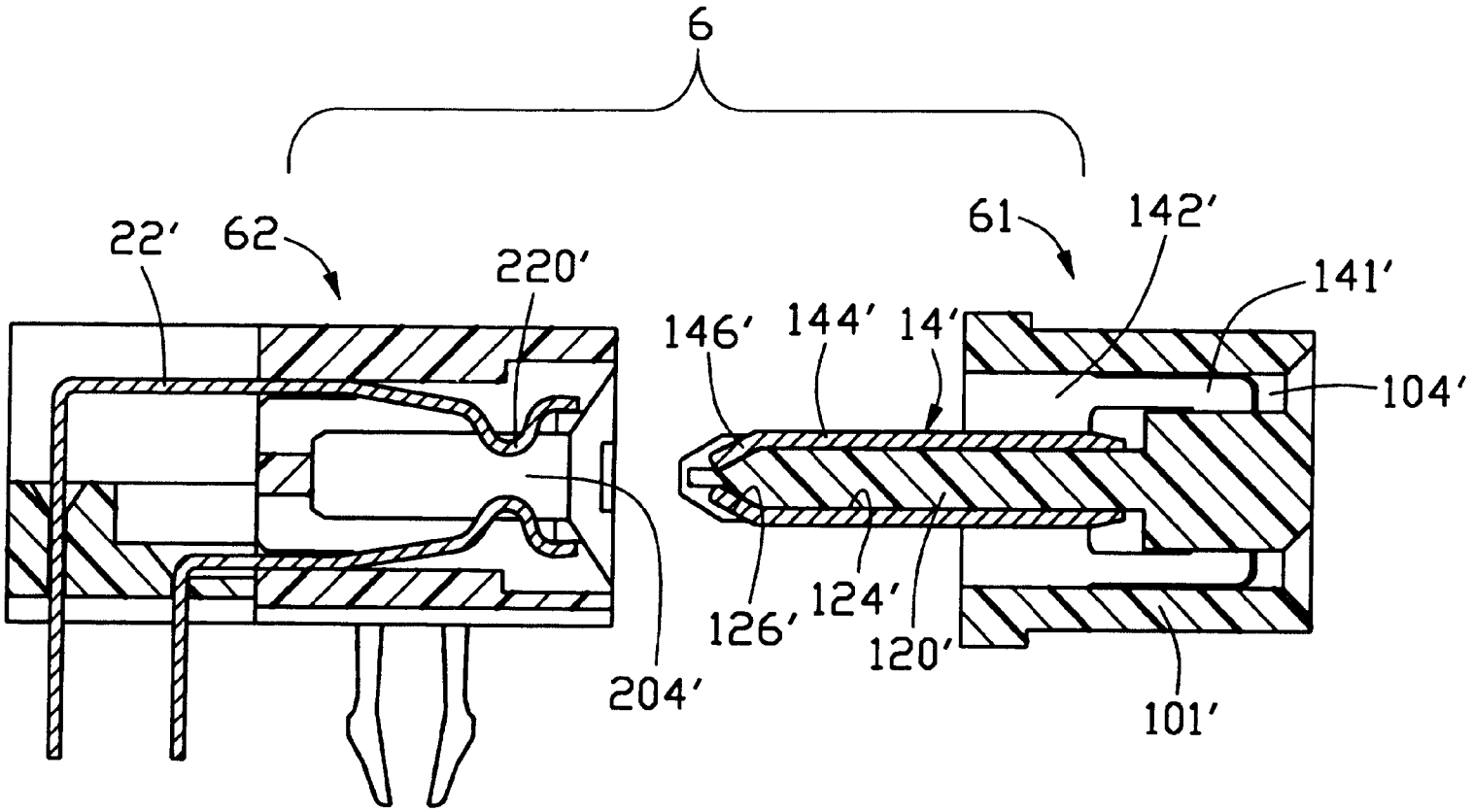
FIG. 6 is a cross-sectional view of an electrical connector assembly in accordance with a second embodiment of the present invention.
Figure 7:
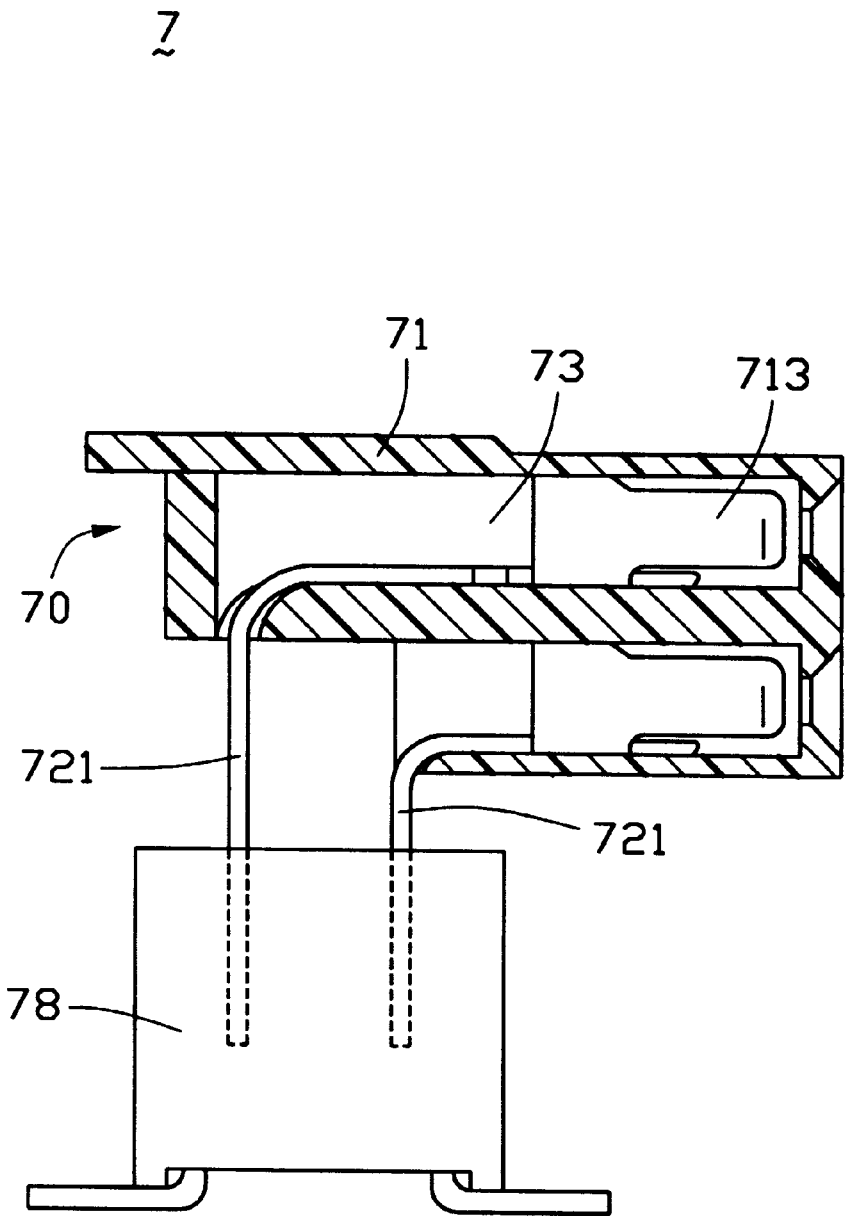
FIG. 7 (PRIOR ART)
FIG. 7 is a partial cross-sectional view of a conventional electrical connector assembly.

In FIG. 6, an electrical connector assembly 6 in accordance with a second embodiment of the present invention comprises a first connector 61 and a complementary second connector 62. The first connector 61 includes a main body 101' defining a plurality of first passageways 104' arranged in two rows, a plurality of first contacts 14', and a body board 120' extending from between the rows of the first passageways 104' and parallel to he first passageways 104'. The body board 120' defines a plurality of recesses 124' in respective opposite sides thereof. Each first contact 14' has a pair of mating fingers 141' and a socket section 142' both received in the first passageways 104', and a flat leg 144' extending directly from the socket section 142' into the recesses 124'. Each leg 144' forms a projection 146' embedded in a depression 126' in communication with a corresponding recess 124', and a pair of protrusions (not shown) similar to he protrusions 147 of the first embodiment.

The second connector 62 defines a slot 204', and provides a plurality of second contacts 22' with mating portions 220' accommodated in the slot 204'. Other numerals in FIG. 6 designate elements similar to the corresponding elements found in FIG. 1.

The body board 120' is adapted for extending into the slot 204', whereby the legs 144' of the first contacts 14' engage with the mating portions 220' of the second contacts 22'. The body board 120' provides support and positioning for the first contacts 14', and ensures reliable electrical connection between the first and second contacts 14', 22'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for connecting a media storing device with a portable electronic device, comprising:

a first connector, comprising:

an insulative upper housing defining a mating surface for mating with the media storing device, an intermediate surface opposite the mating surface, and a plurality of first passageways arranged in upper and lower rows and extending from the mating surface to the intermediate surface;

an insulative lower housing having an insulative body board defining a plurality of recesses on opposite sides thereof and projecting from the intermediate surface; and a plurality of first contacts having socket sections received in the first passageways for engaging with pins of the media storing device, and flat legs received in the recesses of the body board;

a second connector, comprising:

a dielectric housing defining an elongate slot and a plurality of second passageways located at lateral sides of the slot and being in communication with the slot, and a plurality of second contacts received in the second passageways, each second contact having a mating portion extending into the slot and a solder portion extending beyond a bottom side of the housing for being soldered to a printed circuit board; wherein the body board extends into the slot, and the flat legs of the first contacts which are secured in the recesses of the body board engage with the mating portions of the corresponding second contacts; wherein the body board forms a rib between each pair of adjacent recesses, and the body board defines depressions at a free end thereof in communication with the corresponding recesses; wherein the body board is positioned substantially perpendicularly to the intermediate surface, and extends from between the upper and lower rows of first passageways; wherein a securing board extends from the intermediate surface between the two rows of first passageways, and defines a plurality of cutouts in a free end thereof corresponding to the first passageways.

2. The electrical connector assembly as claimed in claim 1, wherein each of the flat legs forms a wedge-like projection at an end thereof received in a corresponding depression.

3. The electrical connector assembly as claimed in claim 2, wherein each of the flat legs forms two lateral protrusions interferingly engaging with the corresponding ribs.

4. The electrical connector assembly as claimed in claim 1, wherein the body board is positioned at a transition board abutting against a bottom side of the securing board and against the intermediate surface.

5. The electrical connector assembly as claimed in claim 4, wherein the body board extends perpendicularly to the transition board and in a direction parallel to the intermediate surface.

6. The electrical connector assembly as claimed in claim 5, wherein the transition board defines two rows of grooves in respective communication with the recesses on opposite sides of the body board.

7. The electrical connector assembly as claimed in claim 5, wherein the first contacts received in the upper row of first passageways extend through the cutouts and the grooves into the recesses of the body board, and the first contacts received in the lower row of first passageways extend through the grooves of the transition board into the recesses.

* * * * *